US009588539B2

(12) United States Patent
Ye et al.

(10) Patent No.: US 9,588,539 B2
(45) Date of Patent: Mar. 7, 2017

(54) BAND-GAP REFERENCE CIRCUIT BASED ON TEMPERATURE COMPENSATION

(71) Applicant: China Electronic Technology Corporation, 24th Research Institute, Chongqing (CN)

(72) Inventors: Rong-Ke Ye, Chongqing (CN); Can Zhu, Chongqing (CN); Gnag-Yi Hu, Chongqing (CN); Lei Zhang, Chongqing (CN); Rong-Bin Hu, Chongqing (CN); Yu-Han Gao, Chongqing (CN); Zheng-Ping Zhang, Chongqing (CN); Yong-Lu Wang, Chongqing (CN); Guang-Bing Chen, Chongqing (CN)

(73) Assignee: CHINA ELECTRONIC TECHNOLOGY CORPORATION, 24TH RESEARCH INSTITUTE, Chongqing (CN)

( * ) Notice: Subject to any disclaimer, the term of this patent is extended or adjusted under 35 U.S.C. 154(b) by 0 days.

(21) Appl. No.: 14/785,349

(22) PCT Filed: Apr. 2, 2014

(86) PCT No.: PCT/CN2014/074603
§ 371 (c)(1),
(2) Date: Oct. 18, 2015

(87) PCT Pub. No.: WO2015/143733
PCT Pub. Date: Oct. 1, 2015

(65) Prior Publication Data

US 2016/0077540 A1 Mar. 17, 2016

(30) Foreign Application Priority Data

Mar. 28, 2014 (CN) ..... 2014 1 0122489

(51) Int. Cl.
*G05F 3/24* (2006.01)
*G05F 3/30* (2006.01)
*G05F 3/26* (2006.01)

(52) U.S. Cl.
CPC ..... *G05F 3/242* (2013.01); *G05F 3/262* (2013.01); *G05F 3/30* (2013.01)

(58) Field of Classification Search
CPC . G05F 3/20; G05F 3/225; G05F 3/242; G05F 3/245; G05F 3/30; G05F 3/262
See application file for complete search history.

(56) References Cited

U.S. PATENT DOCUMENTS 5,570,008 A * 10/1996 Goetz ..... G05F 3/30 323/315
6,144,250 A * 11/2000 Owen ..... G05F 3/265 327/313

(Continued)

FOREIGN PATENT DOCUMENTS

CN 101226414 A 7/2008
CN 101609344 A 12/2009

(Continued)

OTHER PUBLICATIONS

Machine Translation of CN 202433799 U (University China Electronics Sci. & Tech.) originally published on Sep. 12, 2012.*

*Primary Examiner* — Timothy J Dole
*Assistant Examiner* — Yusef Ahmed
(74) *Attorney, Agent, or Firm* — Cheng-Ju Chiang

(57) ABSTRACT

A band-gap reference circuit includes a proportioned current generating circuit, a startup circuit, a current mirror circuit, a high-order temperature compensation generating circuit and a reference generating circuit. The proportioned current generating circuit is configured to generate a current in direct proportion to the absolute temperature. The startup circuit is configured to start up the proportioned current (Continued)

generating circuit when the startup circuit is power on. The current mirror circuit is configured to reproduce a current which is the same as the current in direct proportion to the absolute temperature. The high-order temperature compensation generating circuit is configured to generate a compensation current of high-order temperature coefficient. The reference generating circuit is configured to add the voltage which is generated by the proportioned current generating circuit to a voltage of negative temperature coefficient according to a certain proportion, and output a reference voltage of zero temperature coefficient.

7 Claims, 3 Drawing Sheets

(56) References Cited

U.S. PATENT DOCUMENTS 6,181,196 B1* 1/2001 Nguyen ..... G05F 3/30 327/539
6,292,050 B1* 9/2001 Dooley ..... G05F 3/245 327/540
6,677,808 B1* 1/2004 Sean ..... G05F 3/30 323/313
6,894,473 B1* 5/2005 Le ..... G05F 3/30 323/314
7,075,360 B1* 7/2006 Holloway ..... G05F 3/262 327/513
7,236,048 B1* 6/2007 Holloway ..... G05F 3/30 327/512
2004/0239413 A1* 12/2004 Gubbins ..... H03K 17/223 327/539
2005/0046466 A1* 3/2005 Koelling ..... G05F 3/30 327/539
2006/0087367 A1* 4/2006 Inoue ..... G05F 3/205 327/543
2006/0164158 A1* 7/2006 Kimura ..... G05F 3/30 327/539
2008/0136504 A1* 6/2008 Kim ..... G05F 3/30 327/539
2009/0295360 A1* 12/2009 Hellums ..... G05F 1/468 323/315
2010/0141344 A1* 6/2010 Kim ..... G05F 3/30 330/289
2011/0001546 A1* 1/2011 Guo ..... G01K 3/005 327/512
2011/0068766 A1* 3/2011 Nag ..... G05F 3/30 323/313
2011/0175666 A1* 7/2011 Ballenegger ..... H03F 3/005 327/337
2013/0234781 A1* 9/2013 Bernardinis ..... G05F 3/30 327/513
2013/0328615 A1* 12/2013 Sano ..... G05F 3/30 327/513
2015/0022178 A1* 1/2015 Wen ..... G05F 3/30 323/314
2015/0185754 A1* 7/2015 Liu ..... G05F 3/267 323/313
2015/0205319 A1* 7/2015 De Cremoux ..... H02M 3/18 331/109
2015/0338872 A1* 11/2015 Afzal ..... G05F 3/30 323/313

FOREIGN PATENT DOCUMENTS

CN 101930247 A 12/2010
CN 101930248 A 12/2010
CN 202433799 U 9/2012
CN 103412605 A 11/2013
WO 99/28802 A1 6/1999

* cited by examiner

BAND-GAP REFERENCE CIRCUIT BASED ON TEMPERATURE COMPENSATION

FIELD

The subject matter herein generally relates to a band-gap reference circuit based on high temperature compensation and is used in CMOS technology.

BACKGROUND

A conventional band-gap reference circuit normally comprises a startup circuit, a current generating circuit, current mirror circuit and a reference generating circuit. A startup circuit is configured to generate a current when electrified. A current generating circuit is configured to generate such current as is in direct proportion to absolute temperature. A current mirror circuit is configured to reproduce an exact current. A reference generating circuit is applied to add the voltage caused by such current as is replicated to the voltage of negative temperature coefficient in a certain relation and output a reference voltage featuring zero temperature coefficient. Although a traditional band-gap reference circuit compensates the temperature of the first order, the reference voltage does not remain constant within full temperature range as base-emitter junction voltage of bipolar transistor is related to the higher orders of temperature. So the circuit fails to meet the requirement of high speed high resolution A/D and D/A converters for a stable temperature as a reference signal.

CONTENTS OF THE INVENTION

As a result, the purpose of the invention is to provide a band-gap reference circuit based on temperature compensation to meet requirements of high speed and high precision A/D and D/A converters for a stable temperature as a reference signal.

A band-gap reference circuit based on temperature compensation, the circuit includes a proportioned current generating circuit, a startup circuit, a current mirror circuit, a high-order temperature compensation generating circuit and a reference generating circuit. The proportioned current generating circuit is configured to generate a current in direct proportion to the absolute temperature. The startup circuit is configured to start up the proportioned current generating circuit when the startup circuit is power on. The current mirror circuit is configured to reproduce a current which is the same as the current in direct proportion to the absolute temperature. The high-order temperature compensation generating circuit is configured to generate a compensation current of high-order temperature coefficient. The reference generating circuit is configured to add the voltage which is generated by the proportioned current generating circuit to a voltage of negative temperature coefficient according to a certain proportion, and output a reference voltage of zero temperature coefficient.

In at least one embodiment, the startup circuit includes a first startup field effect transistor, a second startup field effect transistor, a third startup field effect transistor and a startup capacitor; a source of the first startup field effect transistor is configured to receive a DC (direct current) voltage; a drain of the first startup field effect transistor is electrically coupled to a gate of the second startup field effect transistor, a source of the third startup field effect transistor and an upper plate of the startup capacitor respectively; a source of the second startup field effect transistor is configured to receive the DC voltage; a drain of the second startup field effect transistor acts as an output terminal of the startup circuit; a drain of the third startup field effect transistor and a gate of the third startup field effect transistor are electrically coupled together and are grounded; and a lower plate of the startup capacitor is grounded.

In at least one embodiment, the proportioned current generating circuit includes a first proportioned current transistor, a second proportioned current transistor, a proportioned current resistor, a first proportioned current field effect transistor, a second proportioned current field effect transistor, a third proportioned current field effect transistor and a fourth proportioned current field effect transistor; a base of the first proportioned current transistor and a collector of the first proportioned current transistor are electrically coupled together and are grounded; a base of the second proportioned current transistor and a collector of the second proportioned current transistor are electrically coupled together and are grounded; an emitter of the first proportioned current transistor is electrically coupled to a source of the first proportioned current field effect transistor; an emitter of the second proportioned current transistor is electrically coupled to a first terminal of the proportioned current resistor; a source of the second proportioned current field effect transistor is electrically coupled to a second terminal of the proportioned current resistor; a gate of the first proportioned current field effect transistor is electrically coupled to a gate of the second proportioned current field effect transistor; the gate of the first proportioned current field effect transistor is electrically coupled to a drain of the first proportioned current field effect transistor; the gate of the first proportioned current field effect transistor is electrically coupled to the drain of the second startup field effect transistor; the drain of the first proportioned current field effect transistor is electrically coupled to a drain of the third proportioned current field effect transistor; a drain of the second proportioned current field effect transistor is electrically coupled to a drain of the fourth proportioned current field effect transistor; a source of the third proportioned current field effect transistor is configured to receive the DC voltage; a source of the fourth proportioned current field effect transistor is configured to receive the DC voltage; a gate of the third proportioned current field effect transistor is electrically coupled to a gate of the fourth proportioned current field effect transistor; the gate of the fourth proportioned current field effect transistor is electrically coupled to the drain of the fourth proportioned current field effect transistor; and the gate of the fourth proportioned current field effect transistor is electrically coupled to a gate of the first startup field effect transistor.

In at least one embodiment, the current mirror circuit includes a first current mirror field effect transistor and a second current mirror field effect transistor; a gate of the first current mirror field effect transistor is electrically coupled to the drain of the fourth proportioned current field effect transistor; a gate of the second current mirror field effect transistor is electrically coupled to the drain of the fourth proportioned current field effect transistor; and a source of the first current mirror field effect transistor and a source of the second current mirror field effect transistor are configured to receive the DC voltage respectively.

In at least one embodiment, the high-order temperature compensation generating circuit includes a high-order temperature compensation transistor, a first high-order temperature compensation field effect transistor, a second high-order temperature compensation field effect transistor, a third high-order temperature compensation field effect transistor and a fourth high-order temperature compensation field effect transistor; the reference generating circuit comprises a reference transistor and a reference generating resistor; a collector of the high-order temperature compensation transistor is grounded; an emitter of the high-order temperature compensation transistor is electrically coupled to a drain of the second high-order temperature compensation field effect transistor; a base of the high-order temperature compensation transistor is electrically coupled to a drain of the third high-order temperature compensation field effect transistor; a source of the first high-order temperature compensation field effect transistor and a source of the second high-order temperature compensation field effect transistor are configured to receive the DC voltage respectively; a drain of the first high-order temperature compensation field effect transistor is electrically coupled to an emitter of the reference voltage transistor; a gate of the first high-order temperature compensation field effect transistor is electrically coupled to a gate of the second high-order temperature compensation field effect transistor; the gate of the second high-order temperature compensation field effect transistor is electrically coupled to the drain of the second high-order temperature compensation field effect transistor; a source of the third high-order temperature compensation field effect transistor and a source of the fourth high-order temperature compensation field effect transistor are grounded respectively; the drain of the third high-order temperature compensation field effect transistor is electrically coupled to the base of the high-order temperature compensation transistor; a drain of the fourth high-order temperature compensation field effect transistor acts as an input terminal of the high-order temperature compensation generating circuit, and is electrically coupled to a drain of the second current mirror field effect transistor; a gate of the third high-order temperature compensation field effect transistor is electrically coupled to a gate of the fourth high-order temperature compensation field effect transistor; the gate of the fourth high-order temperature compensation field effect transistor is electrically coupled to the drain of the fourth high-order temperature compensation field effect transistor; and the drain of the first high-order temperature compensation field effect transistor acts as an output terminal of the high-order temperature compensation generating circuit.

In at least one embodiment, a base of the first reference transistor and a collector of the first reference transistor are electrically coupled together and are grounded; the emitter of the first reference transistor is electrically coupled to a first terminal of the reference generating resistor; the emitter of the first reference transistor is electrically coupled to the drain of the first high-order temperature compensation field effect transistor; and a second terminal of the reference generating resistor acts as an output terminal of the reference generating circuit, and is electrically coupled to a drain of the first current mirror field effect transistor.

In at least one embodiment, a width-to-length ratio of the third proportioned current field effect transistor, a width-to-length ratio of the fourth proportioned current field effect transistor and a width-to-length ratio of the first current mirror field effect transistor are in proportion of 1:1:1.

In at least one embodiment, the width-to-length ratio of the fourth proportioned current field effect transistor and a width-to-length ratio of the second current mirror field effect transistor are in proportion of 1:a; and a is less than or equal to 1.

In at least one embodiment, a width-to-length ratio of the third high-order temperature compensation field effect transistor and a width-to-length ratio of the fourth high-order temperature compensation field effect transistor are in proportion of 1:b.

Compared with the prior art, the proportioned current generating circuit generates a current in direct proportion to the absolute temperature, the startup circuit starts up the proportioned current generating circuit when the startup circuit is power on, the current mirror circuit reproduces a current which is the same as the current in direct proportion to the absolute temperature, the high-order temperature compensation generating circuit generates a compensation current of high-order temperature coefficient, the reference generating circuit adds the voltage which is generated by the proportioned current generating circuit to a voltage of negative temperature coefficient according to a certain proportion, and output a reference voltage of zero temperature coefficient. Therefore, the compensation at a certain temperature for first order and high order is reached, and a reference voltage of zero temperature coefficient is generated at a certain temperature.

DETAILED DESCRIPTION

Accompanying with the following drawings, the referred embodiments are provided to describe, not to limit, technical approaches in the present invention. Obviously, bearing the essence and concept of the present invention, technologists in this field can make carious changes and modifications to the present invention. It should be understood that those changes and modifications are also covered by claims of the present invention, if they are with the same purpose and within the same scope of the present invention.

It should be understood that such terms as are first, second, and etc are configured to only denote devices but not to limiting the devices. For instance, the contents hereafter may refer first to denote one device, or otherwise, refer second to denote the same device. Notice that when the phrase of "being connected to" is used hereinafter, it means either the two devices being connected or being connected to another device in between. Otherwise, when the phrase of "being directly connected to" is used hereinafter, it only means being connected without any device in between.

The terms being used hereinafter are used to describe the referred embodiment but not to limit the invention. Unless being noted in contents, the use of singular or plural nouns shall not limit the invention.

It should be understood that the use of "comprise" shall not limit the invention about describing or listing features and characteristics of the circuit. There may exist other features and characteristics of the circuit which has not been covered or listed in the invention.

Figure 1:
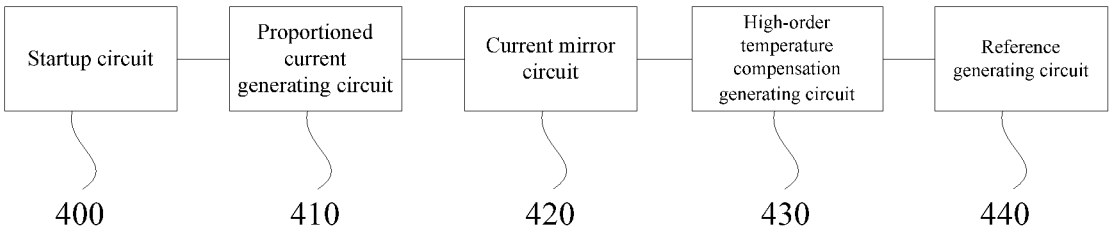
FIG. 1 is a block diagram of an embodiment of a band-gap reference circuit based on temperature compensation.

FIG. 1 illustrates a band-gap reference circuit based on temperature compensation in accordance with a first embodiment. The band-gap reference circuit includes a startup circuit 400, a proportioned current generating circuit 410, a current mirror circuit 420, a high-order temperature compensation generating circuit 430 and a reference generating circuit 440. The startup circuit 400 is configured to start up the proportioned current generating circuit 410 when the startup circuit 400 is power on. The proportioned current generating circuit 410 is configured to generate a current in direct proportion to the absolute temperature. The current mirror circuit 420 is configured to reproduce a current which is the same as the current in direct proportion to the absolute temperature. The high-order temperature compensation generating circuit 430 is configured to generate a compensation current of high-order temperature coefficient. The reference generating circuit 440 is configured to add the voltage which is generated by the proportioned current generating circuit 410 to a voltage of negative temperature coefficient according to a certain proportion, and output a reference voltage of zero temperature coefficient.

Figure 2:
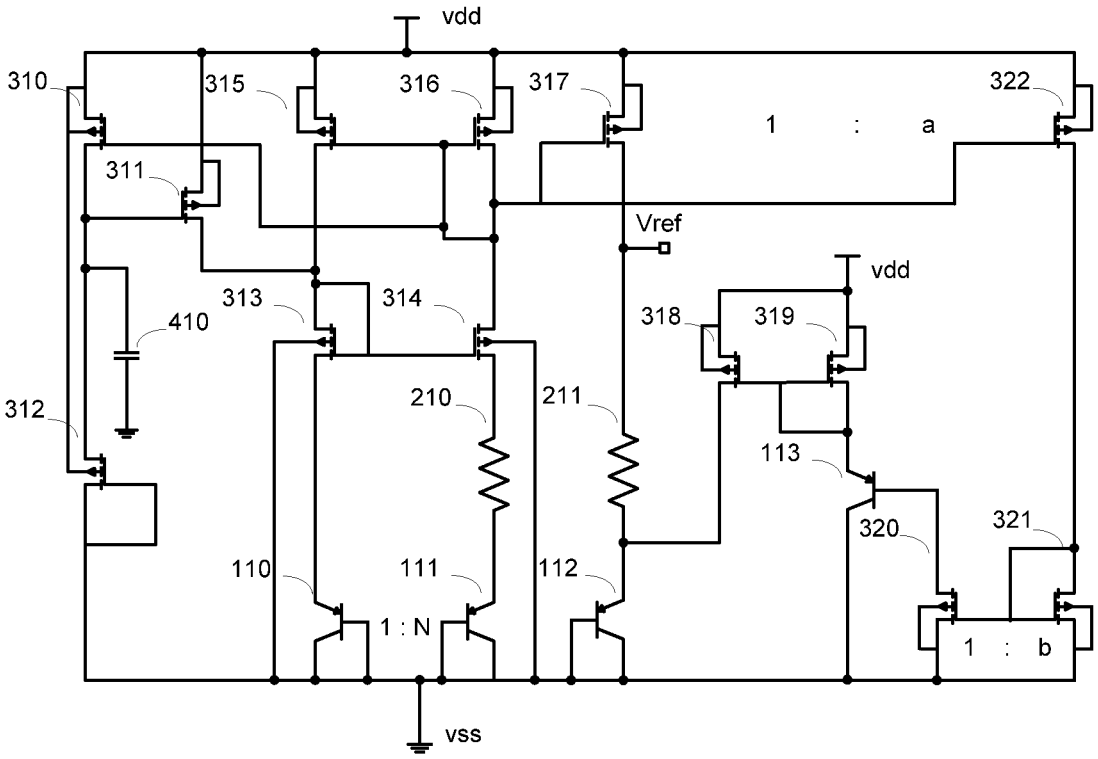
FIG. 2 is a circuit diagram of a first embodiment of the band-gap reference circuit based on temperature compensation of FIG. 1.

FIG. 2 illustrates that the startup circuit 400 includes a first startup field effect transistor 310, a second startup field effect transistor 311, a third startup field effect transistor 312 and a startup capacitor C. A source of the first startup field effect transistor 310 is configured to receive a DC (direct current) voltage Vdd. A drain of the first startup field effect transistor 310 is electrically coupled to a gate of the second startup field effect transistor 311, a source of the third startup field effect transistor 312 and an upper plate of the startup capacitor C respectively. A source of the second startup field effect transistor 311 is configured to receive the DC voltage Vdd. A drain of the second startup field effect transistor 311 acts as an output terminal of the startup circuit 400. A drain of the third startup field effect transistor 312 and a gate of the third startup field effect transistor 312 are electrically coupled together and are grounded. A lower plate of the startup capacitor C is grounded.

The proportioned current generating circuit 410 includes a first proportioned current transistor 110, a second proportioned current transistor 111, a proportioned current resistor 210, a first proportioned current field effect transistor 313, a second proportioned current field effect transistor 314, a third proportioned current field effect transistor 315 and a fourth proportioned current field effect transistor 316. A base of the first proportioned current transistor 110 and a collector of the first proportioned current transistor 110 are electrically coupled together and are grounded. A base of the second proportioned current transistor 111 and a collector of the second proportioned current transistor 111 are electrically coupled together and are grounded. An emitter of the first proportioned current transistor 110 is electrically coupled to a source of the first proportioned current field effect transistor 313. An emitter of the second proportioned current transistor 111 is electrically coupled to a first terminal of the proportioned current resistor 210. A source of the second proportioned current field effect transistor 314 is electrically coupled to a second terminal of the proportioned current resistor 210. A gate of the first proportioned current field effect transistor 313 is electrically coupled to a gate of the second proportioned current field effect transistor 314. The gate of the first proportioned current field effect transistor 313 is electrically coupled to a drain of the first proportioned current field effect transistor 313. The gate of the first proportioned current field effect transistor 313 is electrically coupled to the drain of the second startup field effect transistor 311. The drain of the first proportioned current field effect transistor 313 is electrically coupled to a drain of the third proportioned current field effect transistor 315. A drain of the second proportioned current field effect transistor 314 is electrically coupled to a drain of the fourth proportioned current field effect transistor 316. A source of the third proportioned current field effect transistor 315 is configured to receive the DC voltage Vdd. A source of the fourth proportioned current field effect transistor 316 is configured to receive the DC voltage Vdd. A gate of the third proportioned current field effect transistor 315 is electrically coupled to a gate of the fourth proportioned current field effect transistor 316. The gate of the fourth proportioned current field effect transistor 316 is electrically coupled to the drain of the fourth proportioned current field effect transistor 316. The gate of the fourth proportioned current field effect transistor 316 is electrically coupled to a gate of the first startup field effect transistor 310.

The current mirror circuit 420 includes a first current mirror field effect transistor 317 and a second current mirror field effect transistor 322. A gate of the first current mirror field effect transistor 317 is electrically coupled to the drain of the fourth proportioned current field effect transistor 316. A gate of the second current mirror field effect transistor 322 is electrically coupled to the drain of the fourth proportioned current field effect transistor 316. A source of the first current mirror field effect transistor 317 and a source of the second current mirror field effect transistor 322 are configured to receive the DC voltage Vdd respectively.

The high-order temperature compensation generating circuit 430 includes a high-order temperature compensation transistor 113, a first high-order temperature compensation field effect transistor 318, a second high-order temperature compensation field effect transistor 319, a third high-order temperature compensation field effect transistor 320 and a fourth high-order temperature compensation field effect transistor 321. A collector of the high-order temperature compensation transistor 113 is grounded. An emitter of the high-order temperature compensation transistor 113 is electrically coupled to a drain of the second high-order temperature compensation field effect transistor 319. A base of the high-order temperature compensation transistor 113 is electrically coupled to a drain of the third high-order temperature compensation field effect transistor 320. A source of the first high-order temperature compensation field effect transistor 318 and a source of the second high-order temperature compensation field effect transistor 319 are configured to receive the DC voltage Vdd respectively. A drain of the first high-order temperature compensation field effect transistor 318 is electrically coupled to an emitter of the reference voltage transistor 112. A gate of the first high-order temperature compensation field effect transistor 318 is electrically coupled to a gate of the second high-order temperature compensation field effect transistor 319. The gate of the second high-order temperature compensation field effect transistor 319 is electrically coupled to the drain of the second high-order temperature compensation field effect transistor 319. A source of the third high-order temperature compensation field effect transistor 320 and a source of the fourth high-order temperature compensation field effect transistor 321 are grounded respectively. The drain of the third high-order temperature compensation field effect transistor 320 is electrically coupled to the base of the high-order temperature compensation transistor 113. A drain of the fourth high-order temperature compensation field effect transistor 321 acts as an input terminal of the high-order temperature compensation generating circuit 440, and is electrically coupled to a drain of the second current mirror field effect transistor 322. A gate of the third high-order temperature compensation field effect transistor 320 is electrically coupled to a gate of the fourth high-order temperature compensation field effect transistor 321. The gate of the fourth high-order temperature compensation field effect transistor 321 is electrically coupled to the drain of the fourth high-order temperature compensation field effect transistor 321. The drain of the first high-order temperature compensation field effect transistor 318 acts as an output terminal of the high-order temperature compensation generating circuit 430.

The reference generating circuit 440 includes a reference transistor 112 and a reference generating resistor 211. A base of the first reference transistor 112 and a collector of the first reference transistor 112 are electrically coupled together and are grounded. The emitter of the first reference transistor 112 is electrically coupled to a first terminal of the reference generating resistor 211. The emitter of the first reference transistor 112 is electrically coupled to the drain of the first high-order temperature compensation field effect transistor 318. A second terminal of the reference generating resistor 211 acts as an output terminal of the reference generating circuit 440, and is electrically coupled to a drain of the first current mirror field effect transistor 317.

In at least one embodiment, a width-to-length ratio of the third proportioned current field effect transistor 315, a width-to-length ratio of the fourth proportioned current field effect transistor 316 and a width-to-length ratio of the first current mirror field effect transistor 317 are in proportion of 1:1:1; the width-to-length ratio of the fourth proportioned current field effect transistor 316 and a width-to-length ratio of the second current mirror field effect transistor 322 are in proportion of 1:a, and a is less than or equal to 1. A width-to-length ratio of the third high-order temperature compensation field effect transistor 320 and a width-to-length ratio of the fourth high-order temperature compensation field effect transistor 321 are in proportion of 1:b.

In use, the fourth high-order temperature compensation field effect transistor 321 receives the proportioned current from the second current mirror field effect transistor 322. The proportioned current passes through the base of the high-order temperature compensation transistor 113 via the a current mirror which is formed by the third high-order temperature compensation field effect transistor 320 and the fourth high-order temperature compensation field effect transistor 321. The proportioned current input from the base of the high-order temperature compensation transistor 113 is converted to a non-linear current output from an emitter of the high-order temperature compensation transistor 113. The non-linear current has a fixed positive amplification coefficient for current. The positive amplification coefficient is expressed as $\beta_F$, and $\beta_F$ is calculated by the following formula:

$$\beta_F = \beta_{F0} \times \left(\frac{T}{T_0}\right)^m \tag{101}$$

Wherein, $\beta_{F0}$ is the positive current amplification coefficient at 0 Celsius degree for the high-order temperature compensation transistor 113. $\beta_F$ is the positive current amplification coefficient at T Celsius degree for the high-order temperature compensation transistor 113. m is an exponent of $\beta_F$ and temperature $$\left(\frac{T}{T_0}\right).$$

The formula shows that $\beta_F$ is exponentially related to $$\left(\frac{T}{T_0}\right).$$

The width-to-length ratio of the third high-order temperature compensation field effect transistor 320 and the width-to-length ratio of the fourth high-order temperature compensation field effect transistor 321 are in proportion of 1:b, i.e. $(W/L)_{320}:(W/L)_{321}=1:b$. The proportioned current passes through the fourth high-order temperature compensation field effect transistor 321. The third high-order temperature compensation field effect transistor 320 mirrors the proportioned current to produce a mirror current Iptat/b which is input to the base of the high-order temperature compensation transistor 113. The emitter of the high-order temperature compensation transistor 113 outputs a current which is calculated by the following formula:

$$I_{E113} = (1+\beta_F)I_{B113} = (1+\beta_F) \times \frac{I_{PTAT}}{b} \tag{102}$$

Wherein, $I_{E113}$ is a current on the emitter of the high-order temperature compensation transistor 113. $\beta_F$ is an amplification coefficient of the positive current of the high-order temperature compensation transistor 113. $I_{B113}$ is a current on the base of the high-order temperature compensation transistor 113.

In CMOS technology, $$\frac{1}{\beta_F}$$

is much smaller than 1. The formula 102 is further presented as:

$$I_{E113} \approx \frac{\beta_F}{b} I_{PTAT} \tag{103}$$

The formula 101 is used in the formula 103 to get the following formula:

$$I_{E113} = \frac{\beta_{F0}}{b} I_{PTAT} \times \left(\frac{T}{T_0}\right)^m \tag{104}$$

$$\frac{\beta_{F0}}{b}$$

is set to 1 by properly design, i.e. $\beta_{F0}$=b. A relation of $I_{E113}$ and temperature is calculated by the following formula:

$$I_{E113} \propto \left(\frac{T}{T_0}\right)^m \tag{105}$$

Thereby, a non-linear current of high-order temperature compensation is output from the emitter of the high-order temperature compensation transistor 113 after the proportioned current passing through the current mirror and the high-order temperature compensation transistor 113.

The temperature characteristic of a base-emitter voltage of a bipolar transistor is expressed by the following formula 106:

$$V_{BE}(T) = V_{G0} + \frac{T}{T_0}[V_{BE}(T_0) - V_{G0}] + \frac{KT}{q}\ln\left[\frac{I_C(T)}{I_C(T_0)}\right] - \eta \cdot \frac{KT}{q}\ln\left(\frac{T}{T_0}\right) \tag{106}$$

Wherein, $V_{BE}(T)$ is the base-emitter voltage at T Celsius degree. $V_{BE}(T_0)$ is the base-emitter voltage at T0 Celsius degree. $V_{G0}$ is a silicon band-gap voltage at T0 Celsius degree. η is the temperature coefficient of saturation current which is from 3 to 5. $I_C(T)$ is a collector current of the transistor at T Celsius degree. $I_C(T_0)$ is the collector current of the transistor at T0 Celsius degree.

$$\frac{KT}{q}$$

is a thermal voltage.

When temperature coefficient of collector current of the transistor is:

$$\frac{I_C(T)}{I_C(T_0)} \approx \left(\frac{T}{T_0}\right)^a \tag{107}$$

Wherein, a is an exponent.

The formula 107 is used in the formula 106 to get the following formula:

$$V_{BE}(T) = V_{G0} + \frac{T}{T_0}[V_{BE}(T_0) - V_{G0}] + (\alpha - \eta) \cdot \frac{KT}{q}\ln\left(\frac{T}{T_0}\right) \tag{108}$$

According to the formula 108, if α−η=0, i.e. α=η, the high-order temperature coefficient compensation of $V_{BE}(T)$ is reached.

The formula 105 is used in the formula 106 to get the following formula:

$$V_{BE}(T) = V_{G0} + \frac{T}{T_0}[V_{BE}(T_0) - V_{G0}] + (m - \eta) \cdot \frac{KT}{q}\ln\left(\frac{T}{T_0}\right) \tag{109}$$

The width-to-length ratios of the third high-order temperature compensation field effect transistor 320 and the fourth high-order temperature compensation field effect transistor 321 can be properly designed, and the high-order temperature compensation transistor 113 is properly choose to make m=η. Therefore, the compensation at a certain temperature for first order and high order is reached, and a reference voltage of zero temperature coefficient is generated at a certain temperature.

Figure 3:
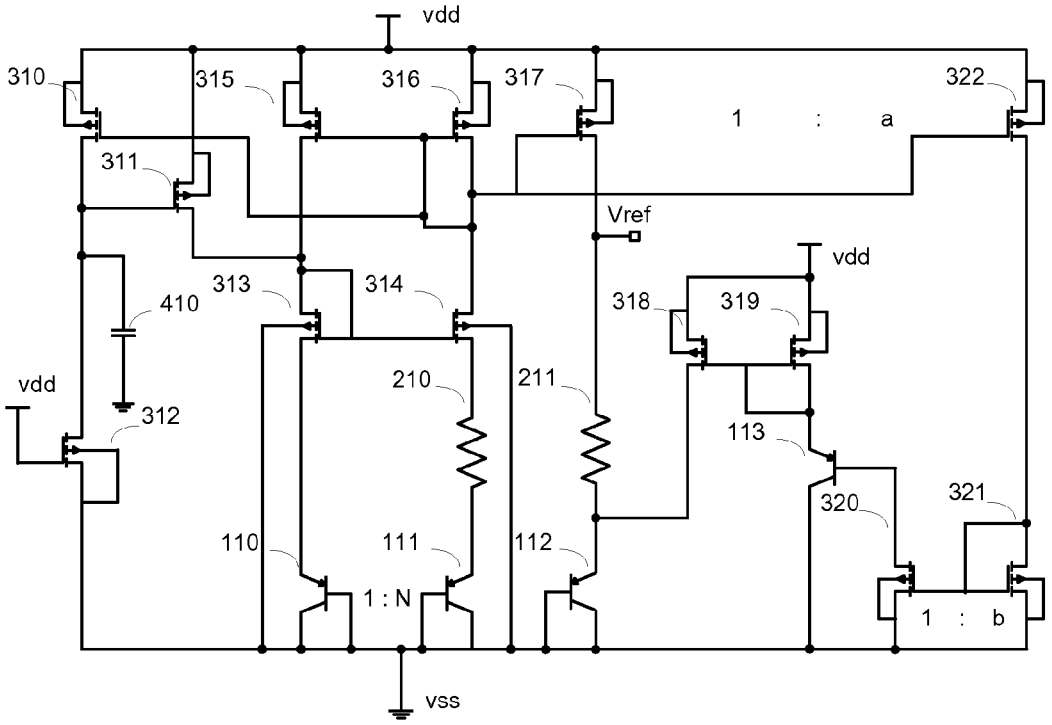
FIG. 3 a circuit diagram of a second embodiment of the band-gap reference circuit based on temperature compensation of FIG. 1.

FIG. 3 illustrates the band-gap reference circuit based on temperature compensation in accordance with a second embodiment. The second embodiment is similar to the first embodiment but with the startup circuit 400 modified. Compared with the first embodiment, the gate of the third startup field effect transistor 312 is configured to receive the DC voltage Vdd, the source of the third startup field effect transistor 312 is grounded, the drain of the third startup field effect transistor 312 is electrically coupled to the drain of the first startup field effect transistor 310 and the upper plate of the startup capacitor C respectively, instead of the above depicted connections of the third startup field effect transistor 312. The modifications can also reach the function of the startup circuit 400.

Figure 4:
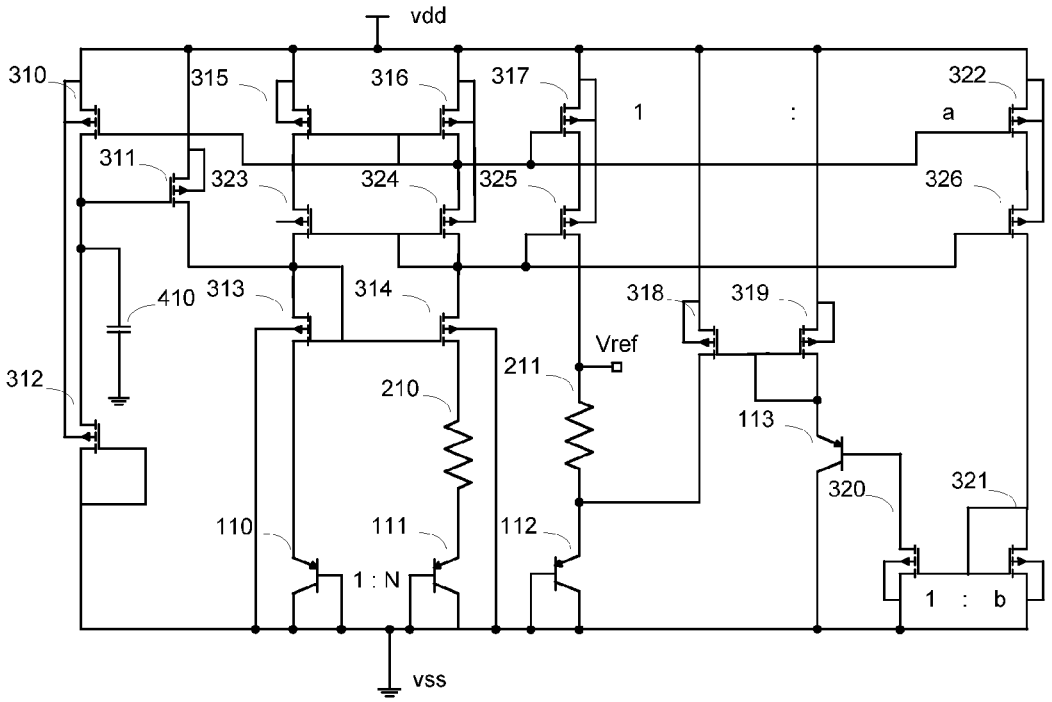
FIG. 4 a circuit diagram of a third embodiment of the band-gap reference circuit based on temperature compensation of FIG. 1.

FIG. 4 illustrates the band-gap reference circuit based on temperature compensation in accordance with a third embodiment. Compared with the first embodiment, a common-source and common-gate current mirror circuit is formed by the third proportioned current field effect transistors 315 and 323, the fourth proportioned current field effect transistors 316 and 324, the first current mirror field effect transistors 317 and 325, and the second current mirror field effect transistors 322 and 326, instead of the proportioned current generating circuit 410 being formed by the third proportioned current field effect transistor 315, the fourth proportioned current field effect transistor 316, and the current mirror circuit 420 being formed by the first current mirror field effect transistor 317 and the second current mirror field effect transistor 322. The modifications improve a matching characteristic of current and a depression effect of the reference voltage.

Figure 5:
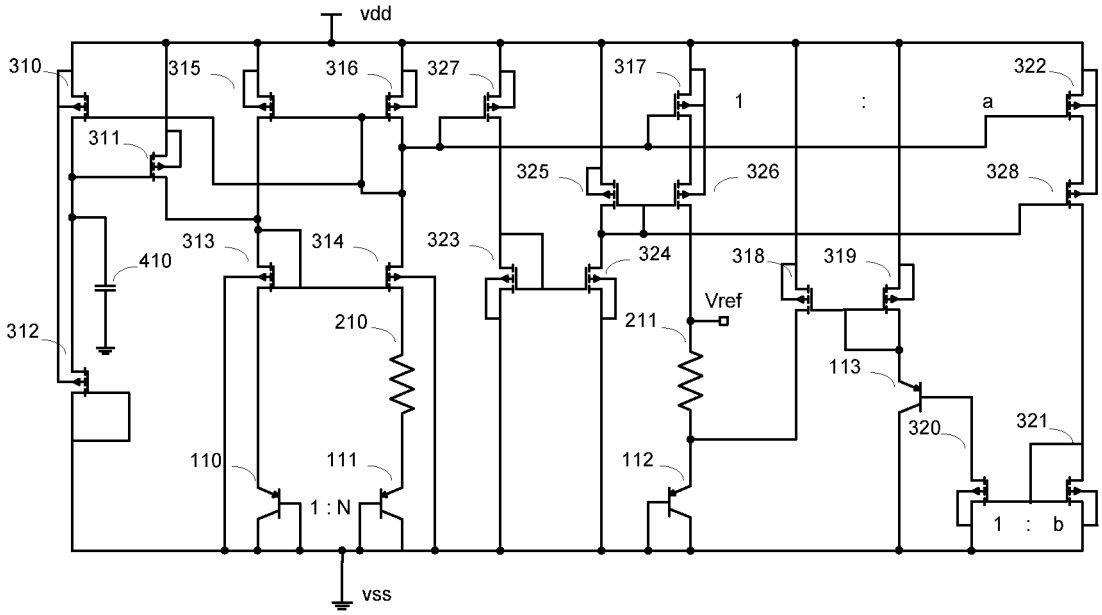
FIG. 5 a circuit diagram of a fourth embodiment of the band-gap reference circuit based on temperature compensation of FIG. 1.

FIG. 5 illustrates the band-gap reference circuit based on temperature compensation in accordance with a fourth embodiment. Compared with the first embodiment, the current mirror is formed by the first current mirror field effect transistor 317 and 326, and the second current mirror field effect transistor 322 and 328, a bias circuit is formed by the bias field effect transistors 323, 324, 325 and 327, instead of the current mirror circuit 420 being formed by the first current mirror field effect transistor 317 and the second current mirror field effect transistor 322. The modifications improve a matching degree of current.

Figure 6:
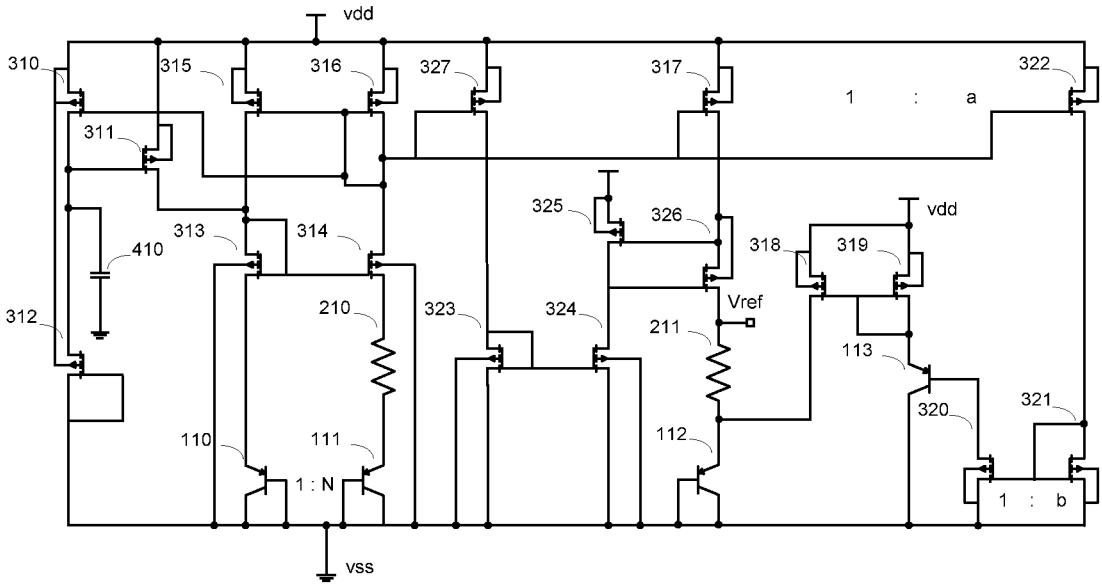
FIG. 6 a circuit diagram of a fifth embodiment of the band-gap reference circuit based on temperature compensation of FIG. 1.

FIG. 6 illustrates the band-gap reference circuit based on temperature compensation in accordance with a fifth embodiment. Compared with the first embodiment, the current mirror has an enhanced output impedance mirror current which is formed by the current mirror field effect transistor 317, 327, 323, 324, 325 and 326, instead of simple current mirror output composed by the first current mirror field effect transistor 317 and the second current mirror field effect transistor 322. The modifications improve the enhanced output impedance of reference voltage and a depression effect of the reference voltage.

Compared with the prior art, the startup circuit 400 starts up the proportioned current generating circuit 410 when electrified; the proportioned current generating circuit 410 generates a current in direct proportion to the absolute temperature. The current mirror circuit 420 is used to reproduce such circuit as is the same as the current in direct proportion to the absolute temperature. The high-order temperature compensation generating circuit 430 generates a compensation current of high-order temperature coefficient. The reference generating circuit 440 adds the voltage caused by the proportioned current to the voltage of negative temperature coefficient in a certain relation and outputting a reference voltage of zero temperature coefficient. Therefore, the compensation at a certain temperature for first order and high order is reached, and a reference voltage of zero temperature coefficient is generated at a certain temperature.

The embodiments shown and described above are only examples. Many details are often found in the art such as the other features of a band-gap reference circuit based on temperature compensation. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A band-gap reference circuit based on temperature compensation, the circuit comprising:

a proportioned current generating circuit configured to generate a current in direct proportion to the absolute temperature;

a startup circuit configured to start up the proportioned current generating circuit when the startup circuit is power on, wherein the startup circuit comprises a first startup field effect transistor, a second startup field effect transistor, a third startup field effect transistor and a startup capacitor; a source of the first startup field effect transistor is configured to receive a direct current voltage; a drain of the first startup field effect transistor is electrically coupled to a gate of the second startup field effect transistor, a source of the third startup field effect transistor and an upper plate of the startup capacitor respectively; a source of the second startup field effect transistor is configured to receive the direct current voltage; a drain of the second startup field effect transistor acts as an output terminal of the startup circuit a drain of the third startup field effect transistor and a gate of the third startup field effect transistor are electrically coupled together and are grounded; and a lower plate of the startup capacitor is grounded;

a current mirror circuit configured to reproduce a current which is the same as the current in direct proportion to the absolute temperature;

a high-order temperature compensation generating circuit configured to generate a compensation current of high-order temperature coefficient; and a reference generating circuit configured to add the voltage which is generated by the proportioned current generating circuit to a voltage of negative temperature coefficient according to a certain proportion, and output a reference voltage of zero temperature coefficient.

2. The band-gap reference circuit based on temperature compensation of claim 1, wherein the proportioned current generating circuit comprises a first proportioned current transistor, a second proportioned current transistor, a proportioned current resistor, a first proportioned current field effect transistor, a second proportioned current field effect transistor, a third proportioned current field effect transistor and a fourth proportioned current field effect transistor; a base of the first proportioned current transistor and a collector of the first proportioned current transistor are electrically coupled together and are grounded; a base of the second proportioned current transistor and a collector of the second proportioned current transistor are electrically coupled together and are grounded; an emitter of the first proportioned current transistor is electrically coupled to a source of the first proportioned current field effect transistor; an emitter of the second proportioned current transistor is electrically coupled to a first terminal of the proportioned current resistor; a source of the second proportioned current field effect transistor is electrically coupled to a second terminal of the proportioned current resistor; a gate of the first proportioned current field effect transistor is electrically coupled to a gate of the second proportioned current field effect transistor; the gate of the first proportioned current field effect transistor is electrically coupled to a drain of the first proportioned current field effect transistor; the gate of the first proportioned current field effect transistor is electrically coupled to the drain of the second startup field effect transistor; the drain of the first proportioned current field effect transistor is electrically coupled to a drain of the third proportioned current field effect transistor; a drain of the second proportioned current field effect transistor is electrically coupled to a drain of the fourth proportioned current field effect transistor; a source of the third proportioned current field effect transistor is configured to receive the direct current voltage; a source of the fourth proportioned current field effect transistor is configured to receive the direct current voltage; a gate of the third proportioned current field effect transistor is electrically coupled to a gate of the fourth proportioned current field effect transistor; the gate of the fourth proportioned current field effect transistor is electrically coupled to the drain of the fourth proportioned current field effect transistor; and the gate of the fourth proportioned current field effect transistor is electrically coupled to a gate of the first startup field effect transistor.

3. The band-gap reference circuit based on temperature compensation of claim 2, wherein the current mirror circuit comprises a first current mirror field effect transistor and a second current mirror field effect transistor; a gate of the first current mirror field effect transistor is electrically coupled to the drain of the fourth proportioned current field effect transistor; a gate of the second current mirror field effect transistor is electrically coupled to the drain of the fourth proportioned current field effect transistor; and a source of the first current mirror field effect transistor and a source of the second current mirror field effect transistor are configured to receive the direct current voltage respectively.

4. The band-gap reference circuit based on temperature compensation of claim 3, wherein the high-order temperature compensation generating circuit comprises a high-order temperature compensation transistor, a first high-order temperature compensation field effect transistor, a second high-order temperature compensation field effect transistor, a third high-order temperature compensation field effect transistor and a fourth high-order temperature compensation field effect transistor; the reference generating circuit comprises a reference voltage transistor and a reference generating resistor; a collector of the high-order temperature compensation transistor is grounded; an emitter of the high-order temperature compensation transistor is electrically coupled to a drain of the second high-order temperature compensation field effect transistor; a base of the high-order temperature compensation transistor is electrically coupled to a drain of the third high-order temperature compensation field effect transistor; a source of the first high-order temperature compensation field effect transistor and a source of the second high-order temperature compensation field effect transistor are configured to receive the direct current voltage respectively; a drain of the first high-order temperature compensation field effect transistor is electrically coupled to an emitter of the reference voltage transistor; a gate of the first high-order temperature compensation field effect transistor is electrically coupled to a gate of the second high-order temperature compensation field effect transistor; the gate of the second high-order temperature compensation field effect transistor is electrically coupled to the drain of the second high-order temperature compensation field effect transistor; a source of the third high-order temperature compensation field effect transistor and a source of the fourth high-order temperature compensation field effect transistor are grounded respectively; a drain of the fourth high-order temperature compensation field effect transistor acts as an input terminal of the high-order temperature compensation generating circuit, and is electrically coupled to a drain of the second current mirror field effect transistor; a gate of the third high-order temperature compensation field effect transistor is electrically coupled to a gate of the fourth high-order temperature compensation field effect transistor; the gate of the fourth high-order temperature compensation field effect transistor is electrically coupled to the drain of the fourth high-order temperature compensation field effect transistor; and the drain of the first high-order temperature compensation field effect transistor acts as an output terminal of the high-order temperature compensation generating circuit.

5. The band-gap reference circuit based on temperature compensation of claim 4, wherein a base of the reference voltage transistor and a collector of the reference voltage transistor are electrically coupled together and are grounded; the emitter of the reference voltage transistor is electrically coupled to a first terminal of the reference generating resistor; and a second terminal of the reference generating resistor acts as an output terminal of the reference generating circuit, and is electrically coupled to a drain of the first current mirror field effect transistor.

6. The band-gap reference circuit based on temperature compensation of claim 5, wherein a width-to-length ratio of the third proportioned current field effect transistor, a width-to-length ratio of the fourth proportioned current field effect transistor and a width-to-length ratio of the first current mirror field effect transistor are in proportion of 1:1:1.

7. The band-gap reference circuit based on temperature compensation of claim 5, wherein the width-to-length ratio of the fourth proportioned current field effect transistor and a width-to-length ratio of the second current mirror field effect transistor are in proportion of 1:a; and a is less than or equal to 1.

* * * * *